US007997574B2

(12) United States Patent
Sugiyama

(10) Patent No.: US 7,997,574 B2
(45) Date of Patent: Aug. 16, 2011

(54) IMAGE FORMING APPARATUS AND CONTROL METHOD THEREOF

(75) Inventor: Tadashi Sugiyama, Sunto-gun (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 338 days.

(21) Appl. No.: 12/206,633

(22) Filed: Sep. 8, 2008

(65) Prior Publication Data

US 2009/0066007 A1 Mar. 12, 2009

Related U.S. Application Data

(60) Provisional application No. 60/971,240, filed on Sep. 10, 2007.

(51) Int. Cl.
*B65H 3/44* (2006.01)

(52) U.S. Cl. ..... 271/9.08; 271/9.12; 271/9.13; 271/9.01

(58) Field of Classification Search ..... 271/9.08, 271/9.12, 9.13, 9.07, 145, 9.01
See application file for complete search history.

(56) References Cited

U.S. PATENT DOCUMENTS 5,085,421 A * 2/1992 Sellers ..... 271/155
5,102,112 A * 4/1992 Takahashi ..... 271/9.08
5,195,734 A * 3/1993 Tanabe ..... 271/9.03
5,335,903 A * 8/1994 Martin et al. ..... 271/157
6,123,329 A * 9/2000 Sato et al. ..... 271/9.01
7,658,375 B2 * 2/2010 Wong et al. ..... 271/164
7,823,869 B2 * 11/2010 Ise ..... 271/9.03
2009/0072467 A1 * 3/2009 Ohno ..... 271/9.01
2009/0200728 A1 * 8/2009 Sugiyama ..... 271/9.01

FOREIGN PATENT DOCUMENTS

JP 6-43710 2/1994
JP 2007-99499 4/2007

* cited by examiner

*Primary Examiner* — Stefanos Karmis
*Assistant Examiner* — Ernesto Suarez
(74) *Attorney, Agent, or Firm* — Patterson & Sheridan, LLP

(57) ABSTRACT

An image forming apparatus includes an apparatus body which includes an attachment portion, a standby tray which is provided adjacent to the attachment portion of the apparatus body and stacks a paper thereon, a paper feeding tray stacks the paper thereon, a movement mechanism which moves the paper from the paper feeding tray located at the mounted position onto the standby tray along the paper conveying path, a holder member which moves to a first position so as to hold the paper at a predetermined position on the paper feeding tray and moves to a second position so as to recede from the paper conveying path, and a lock mechanism which engages with the holder member so as to hold the holder member at the first position when the paper feeding tray is located at the withdrawn position.

11 Claims, 8 Drawing Sheets

IMAGE FORMING APPARATUS AND CONTROL METHOD THEREOF

CROSS-REFERENCE TO RELATED APPLICATIONS

This application claims the benefit of U.S. Provisional Application No. 60/971,240, filed Sep. 10, 2007.

TECHNICAL FIELD

The present invention relates to an image forming apparatus having a withdrawable paper tray.

BACKGROUND

JP-A-6-43710 discloses an image forming apparatus having an intermediate tray for temporarily receiving a paper having an image formed thereon. The image forming apparatus includes an image forming unit; a discharge unit which selectively discharges a paper in accordance with the paper size; an intermediate tray which receives and stacks the paper discharged from the discharge unit; a change unit which selectively changes a conveying direction of the paper having an image formed thereon to a paper discharging direction or a direction of the intermediate tray and reverses the paper; and a conveying unit which conveys the paper sent from the intermediate tray to the image forming unit. The intermediate tray has a stopper approximately formed at the center of the conveying direction, and the stopper defines two divided regions.

In the image forming apparatus, the paper is temporarily collected on the intermediate tray upon performing a both-side printing of the paper. At this time, since the intermediate tray is divided into two regions, the intermediate tray is capable of simultaneously collecting two types of paper thereon.

Incidentally, when the paper is divided by the stopper provided on the intermediate tray as described above, the paper can be divided without any problem. However, when a user first sets the paper on the paper tray, the user may touch the stopper by a hand during the setting operation to thereby deviate the position of the stopper. As a result, a problem arises in that the paper may not set to a correct position.

SUMMARY

An object of the invention is to provide an image forming apparatus capable of setting a paper at a correct position on a paper tray with a simple structure.

In order to achieve the above-described object, according to an aspect of the invention, there is provided an image forming apparatus including: an apparatus body which includes an attachment portion; a standby tray which is provided adjacent to the attachment portion of the apparatus body and stacks a paper thereon; a paper feeding tray which is movable between a mounted position where the paper feeding tray is mounted to the inside of the attachment portion and forms a paper conveying path together with the standby tray and a withdrawn position where the paper feeding tray is withdrawn from the inside of the attachment portion in a protruding manner and stacks the paper thereon; a movement mechanism which moves the paper from the paper feeding tray located at the mounted position onto the standby tray along the paper conveying path; a holder member which moves to a first position so as to hold the paper at a predetermined position on the paper feeding tray when the paper feeding tray is located at the withdrawn position and moves to a second position so as to recede from the paper conveying path when the paper feeding tray is located at the mounted position; and a lock mechanism which engages with the holder member so as to hold the holder member at the first position when the paper feeding tray is located at the withdrawn position.

In order to achieve the above-described object, according to another aspect of the invention, there is provided an image forming apparatus including: an apparatus body which includes an attachment portion; a standby unit which is provided adjacent to the attachment portion of the apparatus body and stacks a paper thereon; a paper feeding unit which is movable between a mounted position where the paper feeding unit is mounted to the inside of the attachment portion and forms a paper conveying path together with the standby unit and a withdrawn position where the paper feeding unit is withdrawn from the inside of the attachment portion in a protruding manner and stacks the paper thereon; a movement unit which moves the paper from the paper feeding unit located at the mounted position onto the standby unit along the paper conveying path; a holder unit which moves to a first position so as to hold the paper at a predetermined position on the paper feeding unit when the paper feeding unit is located at the withdrawn position and moves to a second position so as to recede from the paper conveying path when the paper feeding unit is located at the mounted position; and a lock unit which engages with the holder unit so as to hold the holder unit at the first position when the paper feeding unit is located at the withdrawn position.

According to the invention, it is possible to obtain the image forming apparatus capable of setting the paper at the correct position on the paper tray with the simple structure.

Objects and advantages of the invention will become apparent from the description which follows, or may be learned by practice of the invention.

DESCRIPTION OF THE DRAWINGS

The accompanying drawings illustrate embodiments of the invention, and together with the general description given above and the detailed description given below, serve to explain the principles of the invention.

DETAILED DESCRIPTION

Hereinafter, exemplary embodiments of the invention will be described in detail with reference to the accompanying drawings.

Figure 1:
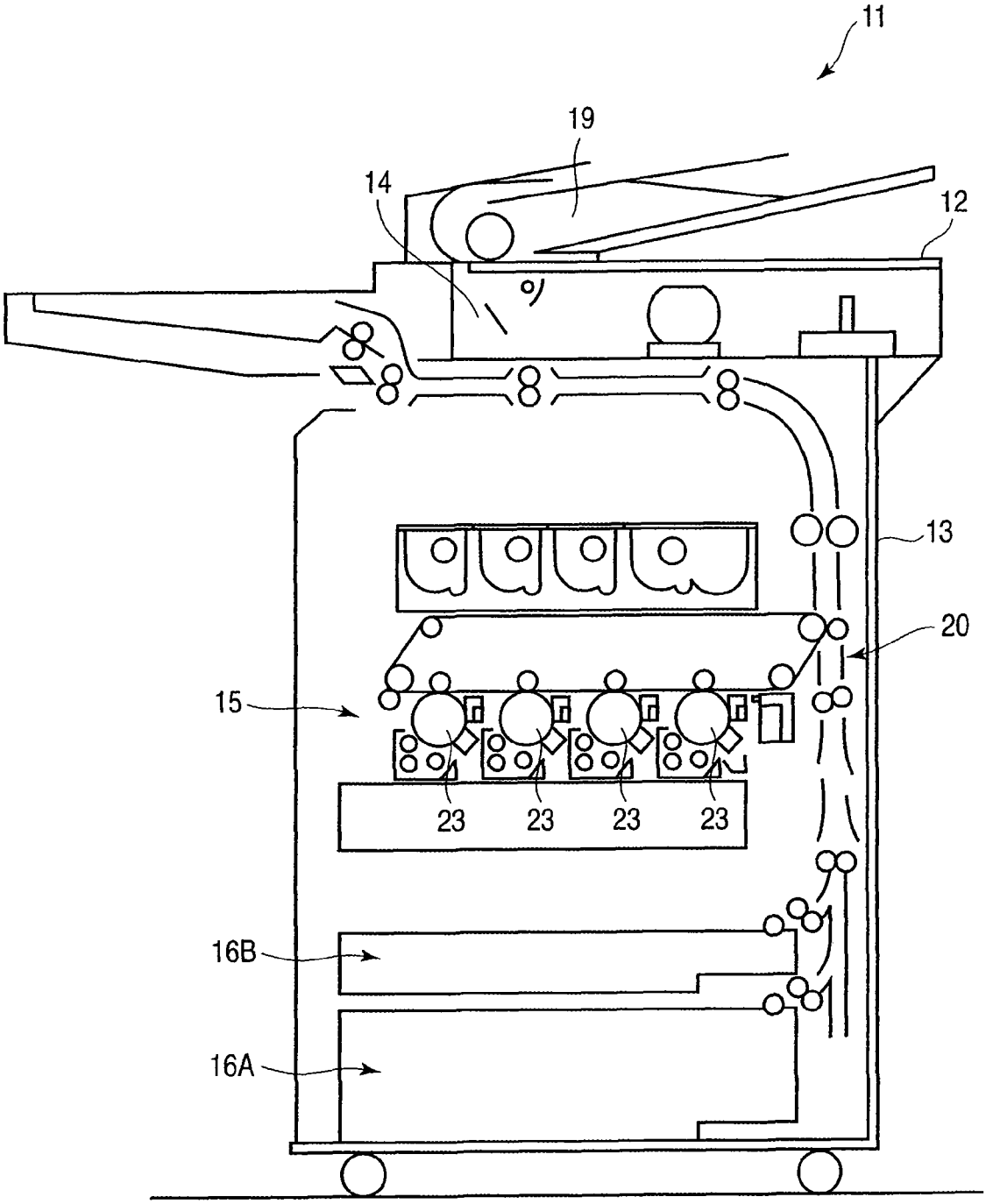
FIG. 1 is a schematic front view showing an image forming apparatus according to an embodiment.

FIG. 1 shows an image forming apparatus 11. The image forming apparatus 11 includes an apparatus body 12 and an outer case 13 corresponding to an outer cover of the apparatus, and the upper surface of the outer case 13 is provided with a document placement table configured as a transparent glass plate. An openable automatic document feeder 19 (hereinafter, simply referred to as an ADF 19) is provided on the document placement table. The ADF 19 is configured to automatically send the document to a predetermined position on the document placement table.

For example, after a document is set on a tray of the ADF 19, the stapling selection, the stapling method, the number of papers to be copied, and the paper size are set. Upon pushing a copy start switch, each sheet of the document set on the tray is automatically fed to a document reading position of the document placement table, and is automatically discharged at an appropriate timing after reading the document.

The image forming apparatus 11 further includes a scanner part 14, a printer part 15, copy paper (hereinafter, simply referred to as a paper P) feeding units 16A and 16B, and a paper conveying mechanism for sending the paper P from the paper feeding units 16A and 16B to respective parts, which are provided in the inside of the outer case 13. The paper feeding unit 16A is a large-capacity paper feeder, and a paper feeding tray 21 and a standby tray 22 are capable of stacking, for example, 600 sheets of paper P thereon, respectively, which is 1,200 sheets of paper P in total. The apparatus body 12 includes an attachment portion 17 for receiving the paper feeding tray 21 and a wall portion 18 for defining a periphery of the attachment portion 17. The wall portion 18 includes a rear wall 18A corresponding to an inner portion of the image forming apparatus 11 and a side wall 18B corresponding to a side portion of the image forming apparatus 11.

The printer part 15 drives a laser device on the basis of image information read by the scanner part 14, and forms an electrostatic latent image based on the image information on a peripheral surface of a photoconductive drum 23. Then, the printer part 15 develops the image by supplying a toner to the electrostatic latent image of the photoconductive drum 23 using a developing device and transfers the toner image to the paper P using a transfer charger. At this time, any one of the paper feeding units 16A and 16B feeds the paper P.

Additionally, the printer part 15 supplies the paper P having the toner image transferred thereto to a fixing device, and fixes the toner image onto the paper P in terms of heating and melting.

The paper feeding unit 16A includes the paper feeding tray 21 which is mounted to the inside of the attachment portion 17 or withdrawn from the attachment portion 17, the standby tray 22 which is provided in the apparatus body 12 so as to be adjacent to the attachment portion 17, a cover member 24 which covers the outside of the paper feeding tray 21 and the standby tray 22, a movement mechanism 25 which moves the paper from the paper feeding tray 21 onto the standby tray 22, a holder member 26 which holds the paper P at a predetermined position on the paper feeding tray 21, and a lock mechanism 27 which regulates a movement of the holder member 26.

Figure 8:
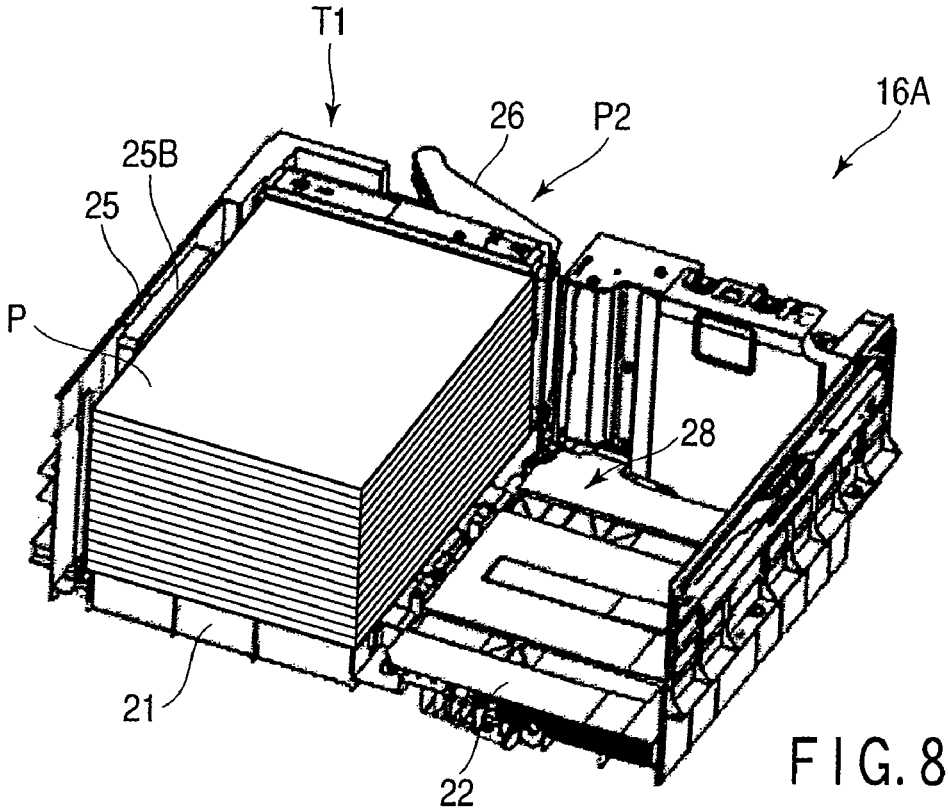
FIG. 8 is a perspective view showing a state where a paper is stacked on a paper feeding tray of the paper feeding unit shown in FIG. 2.

The paper feeding tray 21 is capable of forming a paper conveying path 28 at a position between the paper feeding tray 21 and the standby tray 22 while being located at the mounted position mounted to the inside of the attachment portion 17. The paper feeding tray 21 is movable between a mounted position T1 where the paper feeding tray 21 is mounted to the inside of the attachment portion 17 and a withdrawn position T2 where the paper feeding tray 21 is withdrawn from the inside of the attachment portion 17 in a protruding manner. As shown in FIG. 8, it is possible to stack the paper P on the paper feeding tray 21.

The movement mechanism 25 is formed in an L-shape, and it is possible to move the paper P stacked on the paper feeding tray 21 onto the standby tray 22 along the paper conveying path 28 by driving a motor (not shown). The movement mechanism 25 includes a placement portion 25A on which the paper P is placed and a push portion 25B which is formed uprightly from the placement portion 25A in a direction perpendicular to a direction of the placement portion 25A and comes into contact with a side surface of the paper P.

The lock mechanism 27 is made of, for example, metal material so as to have a bar shape. The lock mechanism 27 is attached to the paper feeding tray 21 so as to slide in a movement direction S of the paper feeding tray 21. The lock mechanism 27 includes a lock body 31 and an upright piece 32 which protrudes upward from the lock body 31. The lock mechanism 27 is capable of sliding between a lock position R1 where the lock mechanism 27 engages with the holder member 26 and a lock release position R2 where the lock mechanism 27 is separated from the holder member 26. The upright piece 32 comes into contact with a protrusion portion 37 of the holder member 26 so as to prevent the holder member 26 (holder body 33) from rotating from a first position P1 to a second position P2. That is, the lock mechanism 27 engages with the holder member 26 so as to hold the holder member 26 at the first position P1 when the paper feeding tray 21 is located at the withdrawn position T2.

The holder member 26 is made of, for example, metal material. The holder member 26 includes the holder body 33 which is substantially formed in a triangular flat-plate shape, a rotary shaft 34 which rotatably supports the holder body 33, a blade portion 35 which extends from one end portion of the holder body 33 so as to have a flat-plate shape along the side surface of the paper P, a contact portion 36 which is provided in the holder body 33 and comes into contact with the wall portion 18, and the protrusion portion 37 which protrudes downward from the holder body 33.

The holder member 26 (holder body 33) is capable of rotating from the first position P1 where the holder member 26 holds the paper P at a predetermined position on the paper feeding tray 21 to the second position P2 where the holder member 26 recedes from the paper conveying path 28. The holder body 33 is located at the first position P1 when the paper feeding tray 21 is located at the withdrawn position T2. Additionally, the holder body 33 is located at the second position P2 when the paper feeding tray 21 is located at the mounted position T1. The contact portion 36 is formed as a semi-circular cam surface so as to smoothly slide on the wall portion 18 upon coming into contact with the wall portion 18. The protrusion portion 37 is formed in, for example, a cylindrical shape. The holder member 26 further includes a spring (not shown) which urges the holder body 33 from the second position P2 toward the first position P1.

Next, an operation of the lock mechanism 27 and the holder member 26 upon mounting the paper feeding tray 21 to the attachment portion 17 will be described with reference to FIGS. 2 to 7. Additionally, a movement operation of the paper P using the movement mechanism 25 will be described with reference to FIGS. 8 to 10.

Figure 2:
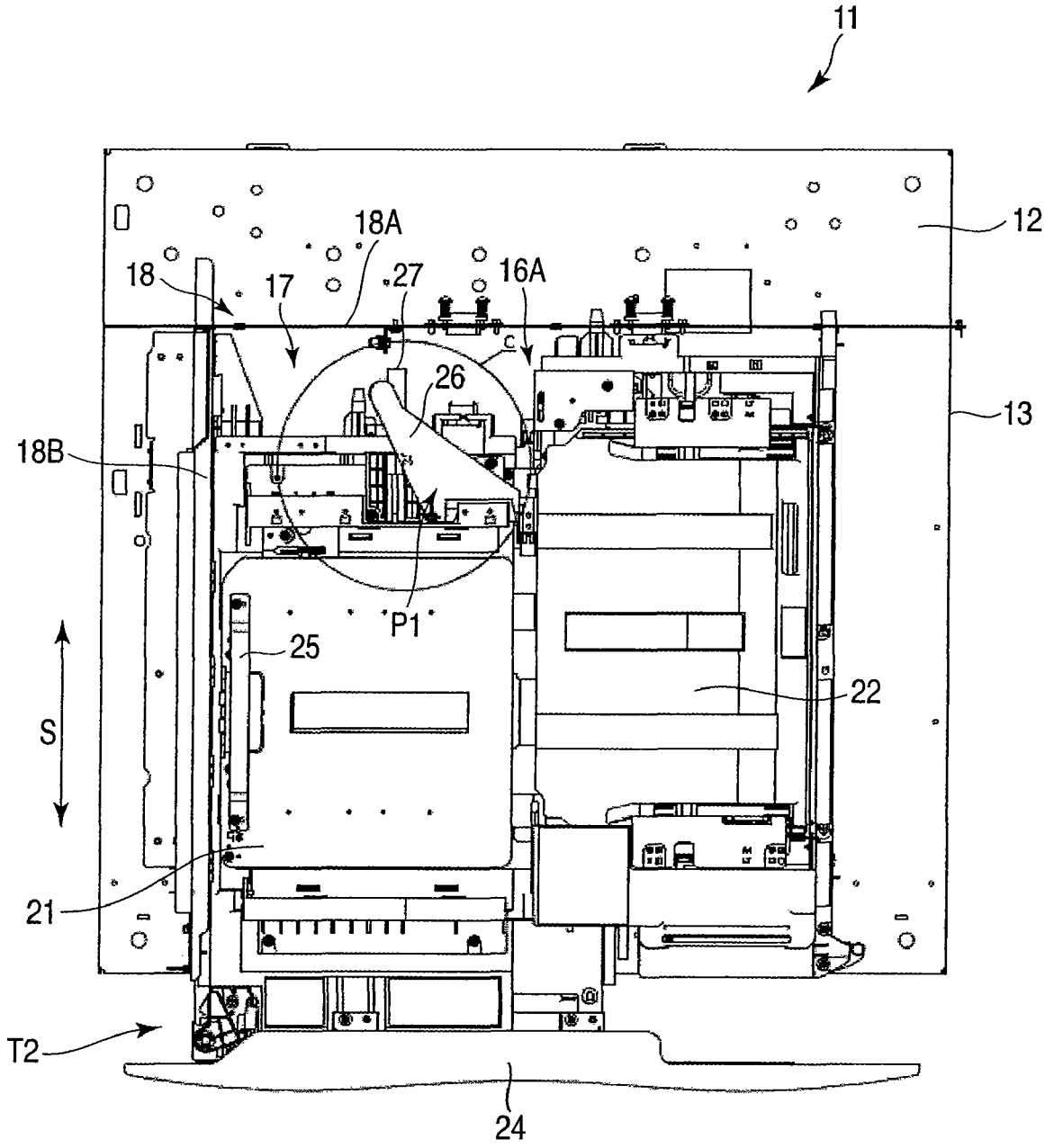
FIG. 2 is a sectional view taken along a horizontal direction of the image forming apparatus shown in FIG. 1.
Figure 3:
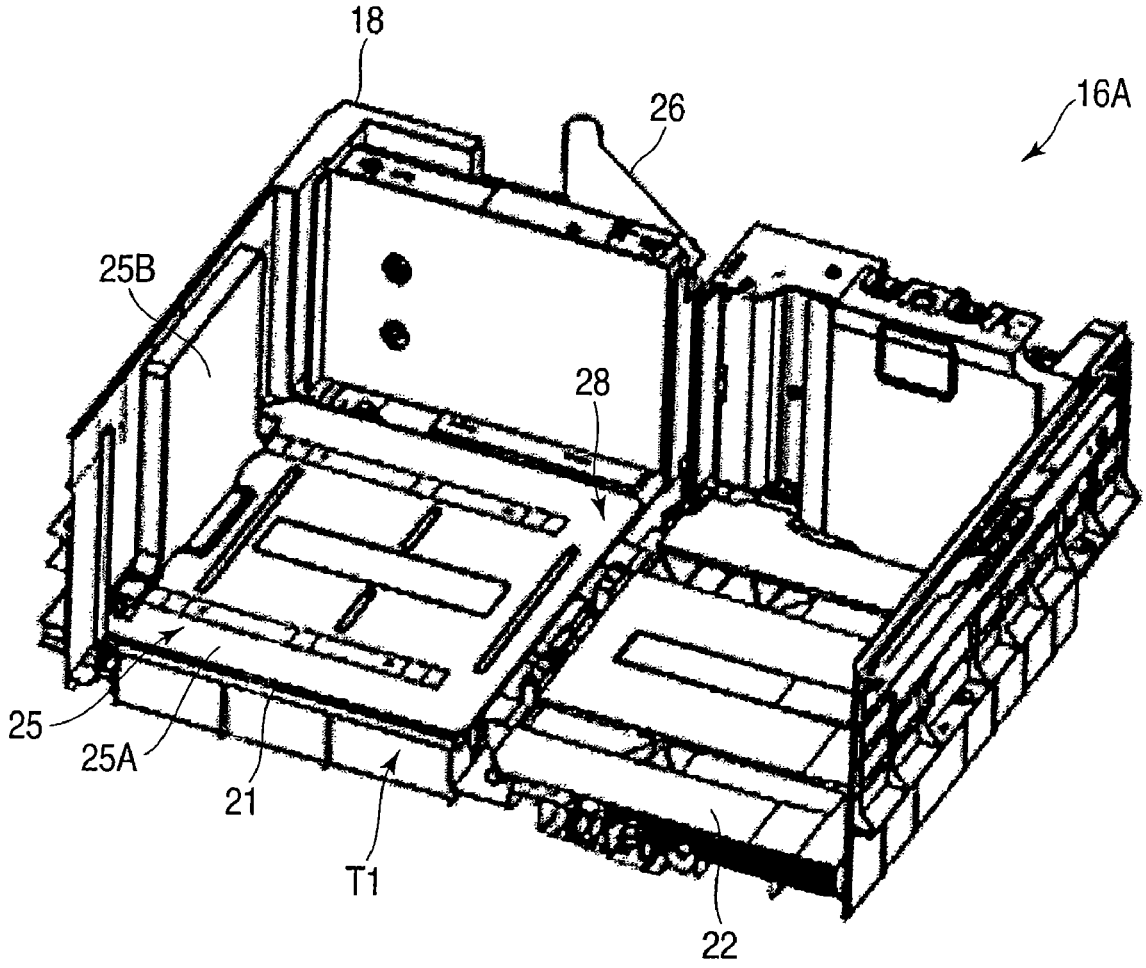
FIG. 3 is a perspective view showing a paper feeding unit shown in FIG. 2 when obliquely viewed from the upside.
Figure 4:
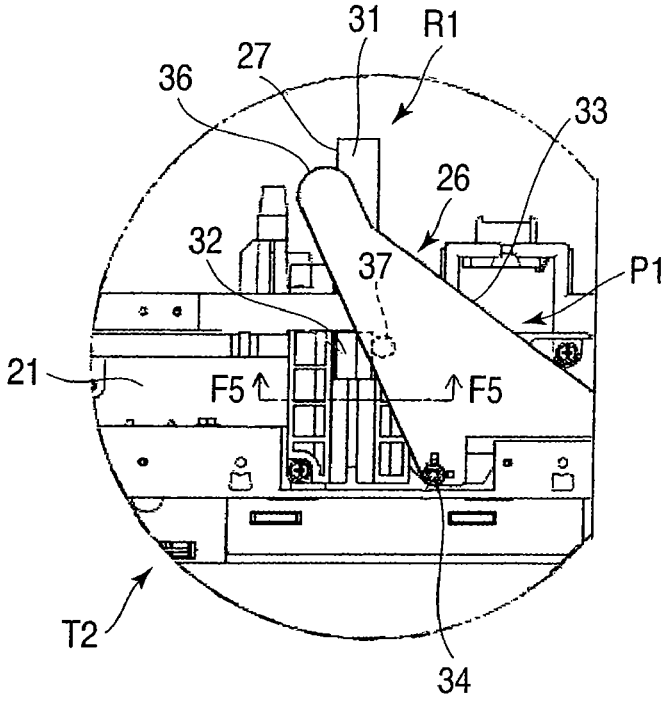
FIG. 4 is an enlarged sectional view showing a structure around a holder member and a lock mechanism of the paper feeding unit shown in FIG. 2.
Figure 5:
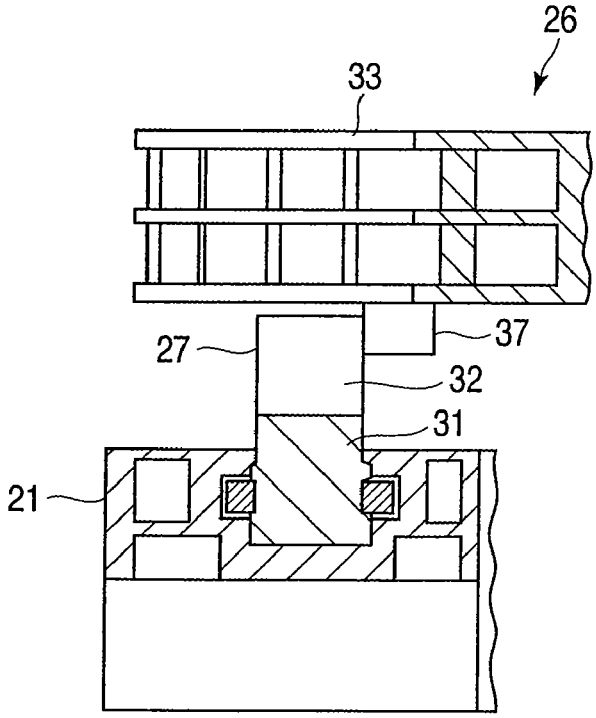
FIG. 5 is a sectional view taken along the line F5-F5 shown in FIG. 4.

FIG. 2 shows a state where a user mounts the paper feeding tray 21 to the attachment portion 17, the paper P being stacked on the paper feeding tray 21. At this time, the paper feeding tray 21 is located at the withdrawn position T2. In FIG. 2, the paper P is not shown. As shown in FIGS. 2, 4, and 5, the holder body 33 of the holder member 26 is located at the first position P1 so as to hold the paper P. The lock mechanism 27 is maintained at the lock position R1 so as to restrict the rotation of the holder body 33.

Figure 6:
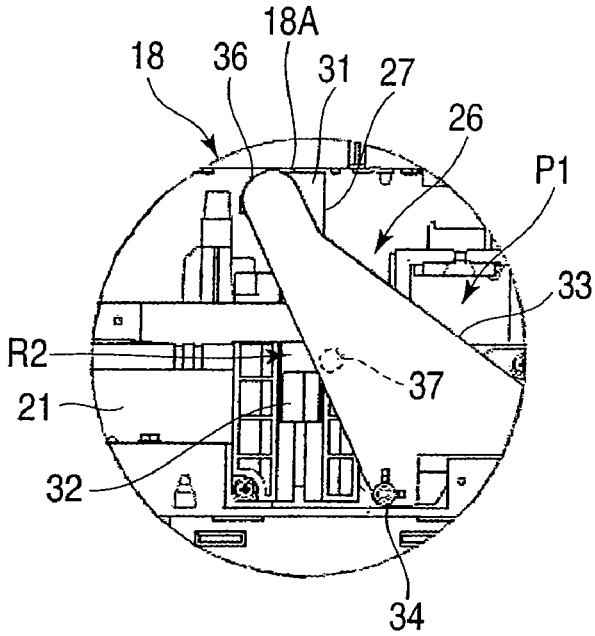
FIG. 6 is a sectional view showing a state where the lock mechanism shown in FIG. 4 is pressed by a wall portion.

When the user pushes further the paper feeding tray 21 to the inside of the apparatus body 12, as shown in FIG. 6, the lock mechanism 27 comes into contact with the rear wall 18A of the wall portion 18 so that the lock mechanism 27 is pressed in a forward direction of the apparatus body 12 and is moved from the lock position R1 to the lock release position R2. Accordingly, the lock of the lock mechanism 27 is released, and thus the holder body 33 becomes a rotatable state.

Figure 7:
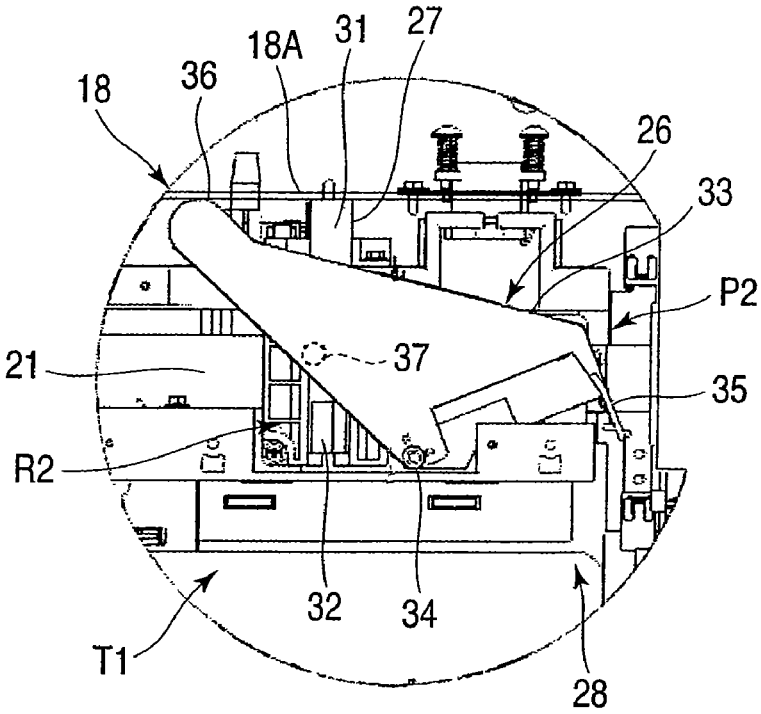
FIG. 7 is a sectional view showing a state where the holder member shown in FIG. 6 is pressed by the wall portion.

When the user pushes further the paper feeding tray 21 to the inside of the apparatus body 12, as shown in FIG. 7, the paper feeding tray 21 moves to the mounted position T1, and the contact portion 36 of the holder member 26 comes into contact with the rear wall 18A of the wall portion 18. At this time, the paper conveying path 28 is formed between the paper feeding tray 21 and the standby tray 22. The holder body 33 rotates about the rotary shaft 34 from the first position P1 to the second position P2, and recedes from the paper conveying path 28. At this time, since the contact portion 36 is formed as the semicircular cam surface, the holder body 33 rotates smoothly.

Figure 9:
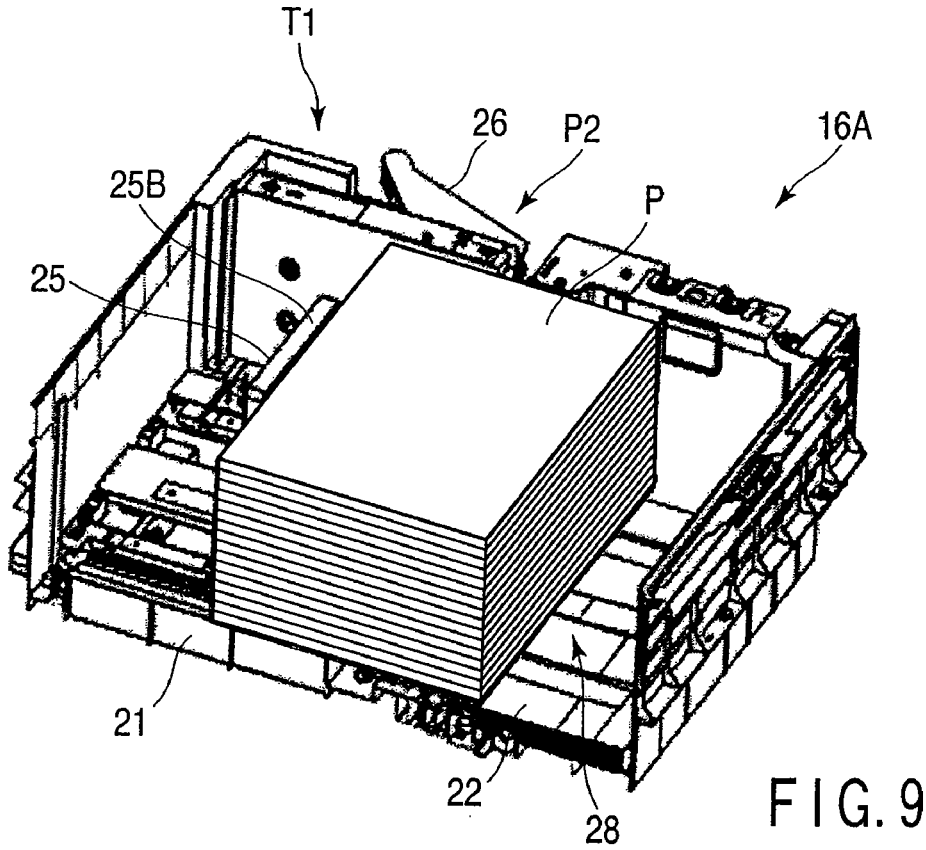
FIG. 9 is a perspective view showing a state where the paper is moved from the paper feeding tray onto a standby tray of the paper feeding unit shown in FIG. 8.
Figure 10:
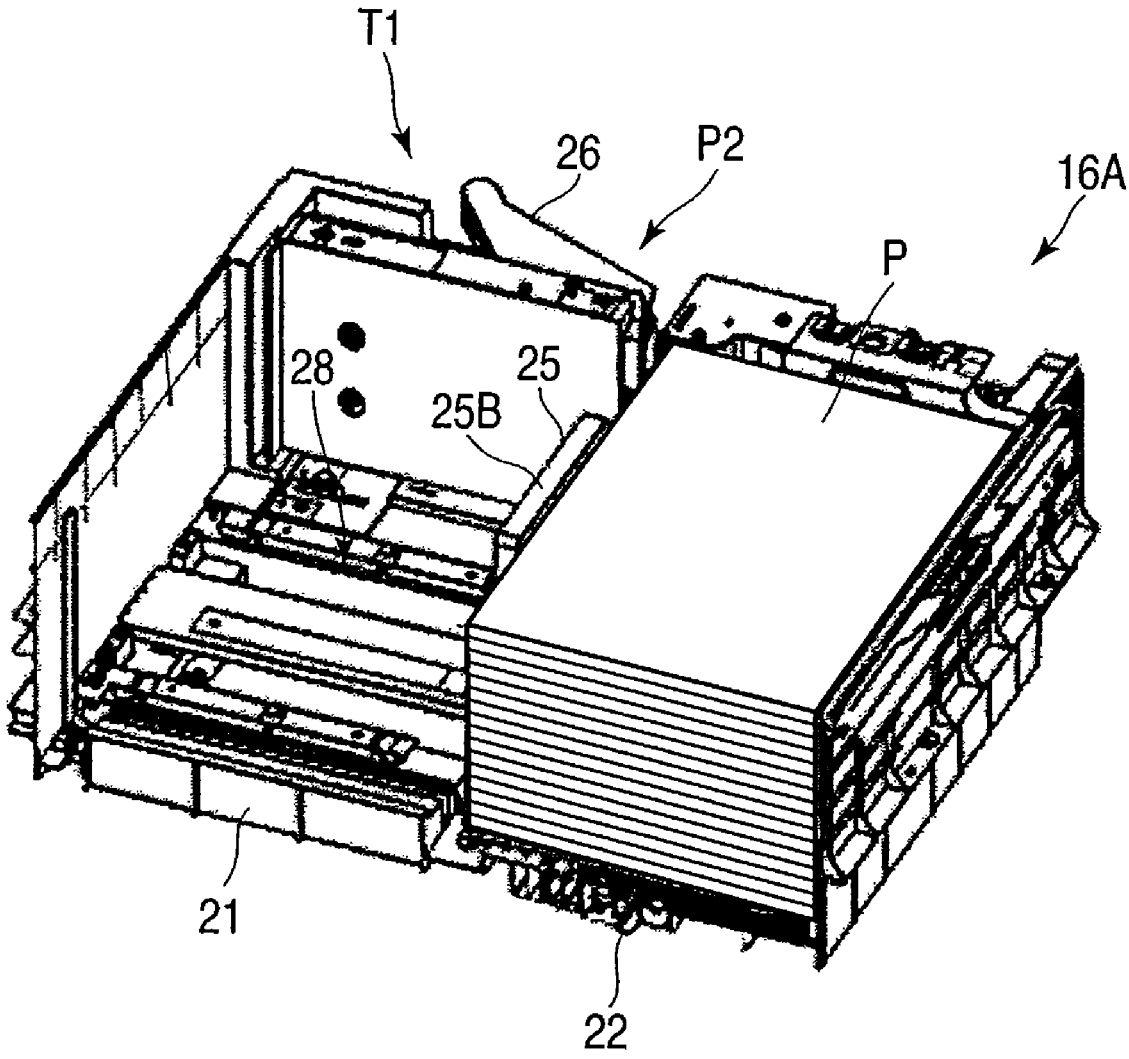
FIG. 10 is a perspective view showing a state where the paper is moved onto the standby tray of the paper feeding unit shown in FIG. 9.

Then, as shown in FIGS. 8 to 10, when the holder body 33 recedes to the second position P2, the movement mechanism 25 slides along the paper conveying path 28 so as to move the paper P onto the standby tray 22. When the movement of the paper P ends, the movement mechanism 25 returns to the paper feeding tray 21 with the paper P left on the standby tray 22. Additionally, it is possible to simultaneously stack the paper P on both the standby tray 22 and the paper feeding tray 21. Accordingly, when the paper P is left on the standby tray 22, the movement mechanism 25 does not perform the movement of the paper P. When the paper P on the standby tray 22 is used up, the movement mechanism 25 moves the paper P onto the standby tray 22.

Upon withdrawing the empty paper feeding tray 21 from the attachment portion 17, the holder body 33 moves from the second position P2 to the first position P1 in terms of the action of the spring. Additionally, in the same manner, the lock mechanism 27 moves from the lock release position R2 to the lock position R1 in terms of the action of the spring (not shown).

According to this embodiment, the image forming apparatus 11 includes the apparatus body 12 which has the attachment portion 17; and the standby tray 22 which is provided adjacent to the attachment portion 17 of the apparatus body 12 and stacks the paper P thereon; the paper feeding tray 21 which is movable between the mounted position T1 where the paper feeding tray 21 is mounted to the inside of the attachment portion 17 and forms the paper conveying path 28 together with standby tray 22 and the withdrawn position T2 where the paper feeding tray 21 is withdrawn from the inside of the attachment portion 17 in a protruding manner and which stacks the paper P thereon; the movement mechanism 25 which moves the paper P from the paper feeding tray 21 located at the mounted position T1 onto the standby tray 22 along the paper conveying path 28; the holder member 26 which moves to the first position P1 so as to hold the paper P at a predetermined position on the paper feeding tray 21 when the paper feeding tray 21 is located at the withdrawn position T2 and moves to the second position P2 so as recede from the paper conveying path 28 when the paper feeding tray 21 is located at the mounted position T1; and the lock mechanism 27 which engages with the holder member 26 so as to hold the holder member 26 at the first position P1 when the paper feeding tray 21 is located at the withdrawn position T2.

With such a configuration, since the lock mechanism 27 holds the holder member 26 at the first position P1, it is possible to prevent the holder member 26 from moving from the first position P1 to the second position P2 upon mounting the paper P to the paper feeding tray 21. Accordingly, it is possible to prevent a case where the paper P is stacked on the paper feeding tray 21 in a misaligned state by preventing the user from moving the holder member 26 by mistake. Additionally, since the user can recognize a stack position where the paper P is stacked on the paper feeding tray 21 in terms of the holder member 26, it is possible for the user to stack the paper P at a correct position.

In this case, the apparatus body 12 includes the wall portion 18 for defining the periphery of the attachment portion 17, and when the paper feeding tray 21 moves from the withdrawn position T2 to the mounted position T1, the lock mechanism 27 release the engagement of the holder member 26 by coming into contact with the wall portion 18. With such a configuration, it is possible to automatically release the engagement between the lock mechanism 27 and the holder member 26 during the mounting operation of the paper feeding tray 21. For this reason, even when the lock mechanism 27 is provided, it is possible to smoothly mount the paper feeding tray 21 without complicating the mounting operation to release the engagement of the lock mechanism 27.

In this case, the holder member 26 includes the contact portion 36 for coming into contact with the wall portion 18, and when the paper feeding tray 21 moves from the withdrawn position T2 to the mounted position T1, the holder member 26 moves from the first position P1 to the second position P2 by coming into contact with the wall portion 18 via the contact portion 36.

With such a configuration, it is possible to automatically move the holder member 26 as well as the lock mechanism 27 during the mounting operation of the paper feeding tray 21. Accordingly, it is possible to move the holder member 26 to the second position P2 without the user's particular operation, thereby preventing the mounting operation of the paper feeding tray 21 from being disturbed.

Next, the image forming apparatus 11 according to a second embodiment will be described with reference to FIG. 11. Although the image forming apparatus 11 according to the second embodiment is different from that of the first embodiment in that a solenoid 41 as an exemplary driving mechanism for rotating the holder member 26 is provided and the holder body 33 does not include the contact portion 36, the other points are the same as those of the first embodiment. For this reason, the different points from the first embodiment will be mainly described. The same reference numerals will be given to the same components, and the description thereof will be omitted.

The holder member 26 is made of, for example, metal material. The holder member 26 includes the holder body 33 which is substantially formed in a triangular flat-plate shape, the rotary shaft 34 which rotatably supports the holder body 33, the blade portion 35 which extends from one end portion of the holder body 33 so as to have a flat-plate shape along the side surface of the paper P, and the protrusion portion 37 which protrudes downward from the holder body 33. The image forming apparatus 11 further includes the solenoid 41 as a driving mechanism which rotates the holder body 33 of the holder member 26.

The holder body 33 of the holder member 26 is capable of rotating from the first position P1 where the holder member 26 holds the paper P at a predetermined position on the paper feeding tray 21 to the second position P2 where the holder member 26 recedes from the paper conveying path 28. The holder body 33 is located at the first position P1 when the paper feeding tray 21 is located at the withdrawn position T2. Additionally, the holder body 33 is located at the second position P2 when the paper feeding tray 21 is located at the mounted position T1. The protrusion portion 37 is formed in, for example, a cylindrical shape. The holder member 26 further includes a spring 42 which urges the holder body 33 from the second position P2 toward the first position P1.

Next, an operation of the lock mechanism 27 and the holder member 26 upon mounting the paper feeding tray 21 to the attachment portion 17 will be described with reference to FIG. 11. Additionally, since a movement operation of the paper P using the movement mechanism 25 is the same as that of the first embodiment, the description thereof will be omitted.

Figure 11:
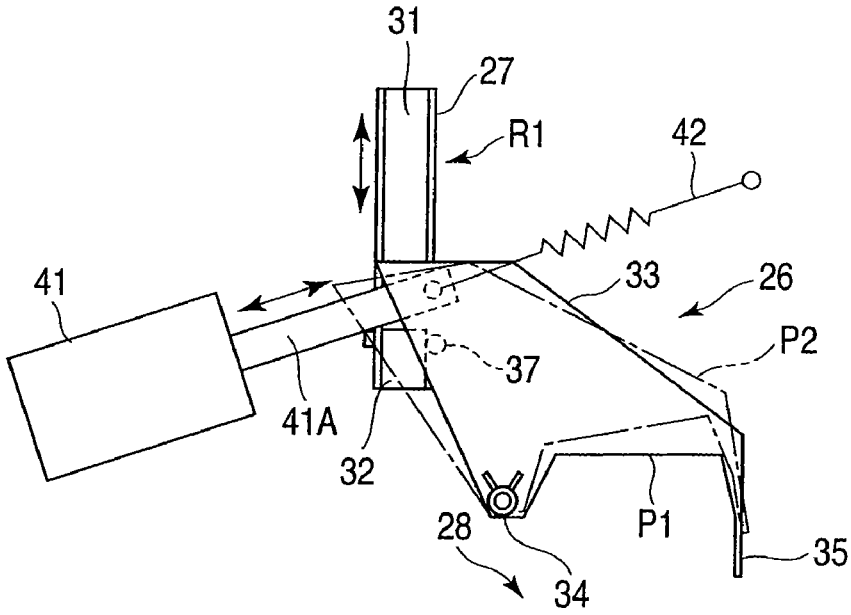
FIG. 11 is an enlarged top view showing the structure around the holder member and the lock mechanism of the image forming apparatus according to a second embodiment.

As depicted by the solid line shown in FIG. 11, the holder body 33 of the holder member 26 is located at the first position P1 so as to hold the paper P. The lock mechanism 27 is maintained at the lock position R1 so as to restrict the rotation of the holder body 33.

When the user pushes the paper feeding tray 21 to the inside of the apparatus body 12, the lock mechanism 27 comes into contact with the rear wall 18A of the wall portion 18 so that the lock mechanism 27 is pressed in a forward direction of the apparatus body 12 and is moved from the lock position R1 to the lock release position R2. Accordingly, the lock of the lock mechanism 27 is released, and thus the holder body 33 becomes a rotatable state.

When the user pushes further the paper feeding tray 21 to the inside of the apparatus body 12, the paper feeding tray 21 moves to the mounted position T1. At this time, the paper conveying path 28 is formed between the paper feeding tray 21 and the standby tray 22. At the same time, a control part (not shown) of the image forming apparatus 11 drives the solenoid 41 to suck a plunger 41A to the inside. Accordingly, as depicted by the dashed-two dotted line shown in FIG. 11, the holder body 33 rotates about the rotary shaft 34 from the first position P1 to the second position P2, and recedes from the paper conveying path 28.

When the paper P is conveyed from the paper feeding tray 21 onto the standby tray 22 and the empty paper feeding tray 21 is withdrawn from the attachment portion 17, the solenoid 41 releases the suction of the plunger 41A. Also, the holder body 33 moves from the second position P2 to the first position P1 in terms of the action of the spring 42. Additionally, in the same manner, the lock mechanism 27 moves from the lock release position R2 to the lock position R1 in terms of the action of the spring (not shown).

According to the second embodiment, the image forming apparatus 11 further includes the driving mechanism for moving the holder member 26 from the first position P1 to the second position P2 when the paper feeding tray 21 moves from the withdrawn position T2 to the mounted position T1. According to this embodiment, it is possible to prevent the holder member 26 from moving from the first position P1 to the second position P2 by using the lock mechanism 27 upon stacking the paper P on the paper feeding tray 21. Additionally, even in the structure provided with the driving mechanism, it is possible to move the holder member 26 from the first position P1 to the second position P2 in the same manner as the first embodiment.

Next, the image forming apparatus 11 according to a third embodiment will be described with reference to FIG. 12. Although the image forming apparatus 11 according to the third embodiment is different from the second embodiment in that the solenoid for rotating the holder member 26 is not provided, the other points are the same as those of the second embodiment. For this reason, the different points from the second embodiment will be described. The same reference numerals will be given to the same components, and the description thereof will be omitted.

The holder member 26 according to the third embodiment rotates from the first position P1 to the second position P2 in terms of a pressing of the paper P upon conveying the paper P from the paper feeding tray 21 onto the standby tray 22.

Figure 12:
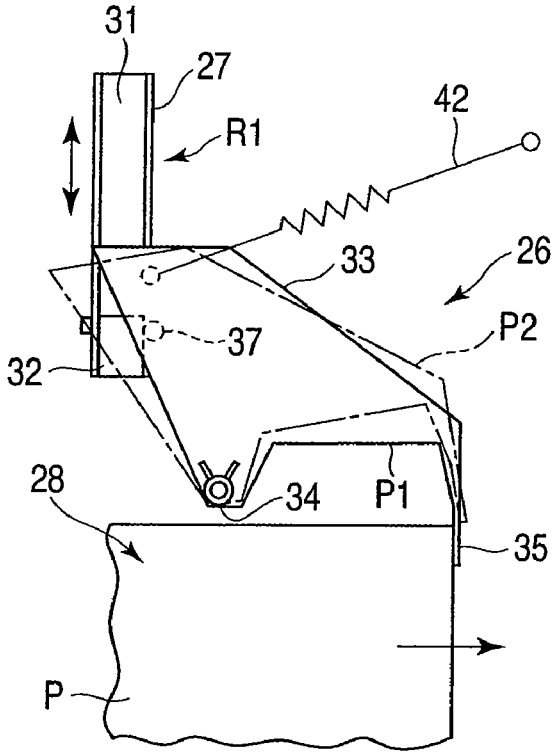
FIG. 12 is an enlarged top view showing the structure around the holder member and the lock mechanism of the image forming apparatus according to a third embodiment.

As depicted by the solid line shown in FIG. 12, the holder body 33 of the holder member 26 is located at the first position P1 so as to hold the paper P. The lock mechanism 27 is maintained at the lock position R1 so as to restrict the rotation of the holder body 33.

When the user pushes the paper feeding tray 21 to the inside of the apparatus body 12, the lock mechanism 27 comes into contact with the rear wall 18A of the wall portion 18 so that the lock mechanism 27 is pressed in a forward direction of the apparatus body 12 and is moved from the lock position R1 to the lock release position R2. Accordingly, the lock of the lock mechanism 27 is released, and thus the holder body 33 becomes a rotatable state.

When the user pushes further the paper feeding tray 21 to the inside of the apparatus body 12, the paper feeding tray 21 moves to the mounted position T1. At this time, the paper conveying path 28 is formed between the paper feeding tray 21 and the standby tray 22. Then, the movement mechanism 25 is driven so as to move the paper P from the paper feeding tray 21 onto the standby tray 22. At this time, since the holder body 33 of the holder member 26 is pressed by the paper P, as depicted by the dashed-two dotted line shown in FIG. 12, the holder member 26 rotates about the rotary shaft 34 from the first position P1 to the second position P2, and recedes from the paper conveying path 28.

When the paper P is conveyed from the paper feeding tray 21 onto the standby tray 22 and the empty paper feeding tray 21 is withdrawn from the attachment portion 17, the holder body 33 moves from the second position P2 to the first position P1 in terms of the action of the spring 42. Additionally, in the same manner, the lock mechanism 27 moves from the lock release position R2 to the lock position R1 in terms of the action of the spring (not shown).

According to the third embodiment, since the holder member 26 is pressed by the paper P moved by the movement mechanism 25, the holder member moves from the first position P1 to the second position P2. According to this embodiment, since the lock mechanism 27 is provided, it is possible to prevent the holder member 26 from moving from the first position P1 to the second position P2 upon stacking the paper P on the paper feeding tray 21. Additionally, since it is possible to move the holder member 26 from the first position P1 to the second position P2 in terms of a pressing force of the paper P, it is not necessary to provide an additional driving mechanism, thereby simplifying the structure.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming apparatus comprising:

an apparatus body which includes an attachment portion, wherein the apparatus body includes a wall portion which defines a periphery of the attachment portion;

a standby tray which is provided adjacent to the attachment portion of the apparatus body and stacks a paper thereon;

a paper feeding tray which is movable between a mounted position where the paper feeding tray is mounted to the inside of the attachment portion and forms a paper conveying path together with the standby tray and a withdrawn position where the paper feeding tray is withdrawn from the inside of the attachment portion in a protruding manner and stacks the paper thereon;

a movement mechanism which moves the paper from the paper feeding tray at the mounted position onto the standby tray along the paper conveying path;

a holder member which moves to a first position so as to hold the paper at a predetermined position on the paper feeding tray when the paper feeding tray is at the withdrawn position and moves to a second position so as to recede from the paper conveying path when the paper feeding tray is at the mounted position; and a lock mechanism which engages with the holder member so as to hold the holder member at the first position when the paper feeding tray is at the withdrawn position, wherein when the paper feeding tray moves from the withdrawn position to the mounted position, the lock mechanism releases the engagement with the holder member by coming into contact with the wall portion.

2. The apparatus according to claim 1, wherein the holder member includes a contact portion which comes into contact with the wall portion when the paper feeding tray moves from the withdrawn position to the mounted position.

3. The apparatus according to claim 1, further comprising:

a driving mechanism which moves the holder member from the first position to the second position when the paper feeding tray moves from the withdrawn position to the mounted position.

4. The apparatus according to claim 1, wherein the holder member moves from the first position to the second position while being pressed by the paper moved by the movement mechanism.

5. An image forming apparatus comprising:

an apparatus body which includes an attachment portion, wherein the apparatus body includes a wall portion which defines a periphery of the attachment portion;

a standby unit which is provided adjacent to the attachment portion of the apparatus body and stacks a paper thereon;

a paper feeding unit which is movable between a mounted position where the paper feeding unit is mounted to the inside of the attachment portion and forms a paper conveying path together with the standby unit and a withdrawn position where the paper feeding unit is withdrawn from the inside of the attachment portion in a protruding manner and stacks the paper thereon;

a movement unit which moves the paper from the paper feeding unit at the mounted position onto the standby unit along the paper conveying path;

a holder unit which moves to a first position so as to hold the paper at a predetermined position on the paper feeding unit when the paper feeding unit is at the withdrawn position and moves to a second position so as to recede from the paper conveying path when the paper feeding unit is at the mounted position; and a lock unit which engages with the holder unit so as to hold the holder unit at the first position when the paper feeding unit is at the withdrawn position, wherein when the paper feeding unit moves from the withdrawn position to the mounted position, the lock unit releases the engagement with the holder unit by coming into contact with the wall portion.

6. The apparatus according to claim 5, further comprising:

a driving unit which moves the holder unit from the first position to the second position when the paper feeding unit moves from the withdrawn position to the mounted position.

7. The apparatus according to claim 5, wherein the holder unit includes a contact portion which comes into contact with the wall portion when the paper feeding unit moves from the withdrawn position to the mounted position.

8. The apparatus according to claim 5, wherein the holder unit moves from the first position to the second position while being pressed by the paper moved by the movement unit.

9. A method of controlling the image forming apparatus including an apparatus body which includes an attachment portion; a standby tray which is provided adjacent to the attachment portion of the apparatus body and stacks a paper thereon; a paper feeding tray which is movable between a mounted position where the paper feeding tray is mounted to the inside of the attachment portion and forms a paper conveying path together with the standby tray and a withdrawn position where the paper feeding tray is withdrawn from the inside of the attachment portion in a protruding manner and stacks the paper thereon; a movement mechanism which moves the paper from the paper feeding tray at the mounted position onto the standby tray along the paper conveying path; a holder member which holds the paper; and a lock mechanism which is capable of engaging with the holder member, wherein the holder member moves to a first position so as to hold the paper at a predetermined position on the paper feeding tray when the paper feeding tray is at the withdrawn position and moves to a second position so as to recede from the paper conveying path when the paper feeding tray is at the mounted position, wherein the lock mechanism engages with the holder member so as to hold the holder member at the first position when the paper feeding tray is at the withdrawn position, and wherein when the paper feeding tray moves from the withdrawn position to the mounted position, the lock mechanism releases the engagement with the holder member by coming into contact with a wall portion of the apparatus body.

10. The method according to claim 9, wherein when the paper feeding tray moves from the withdrawn position to the mounted position, the holder member moves from the first position to the second position by coming into contact with the wall portion via a contact portion.

11. The method according to claim 9, wherein the holder member moves from the first position to the second position while being pressed by the paper moved by the movement mechanism.

* * * * *